United States Patent [10]

Barber

[11] 4,054,870

[45] Oct. 18, 1977

[54] RINGER ASSEMBLY

[75] Inventor: Eugene Barber, Glen, Miss.

[73] Assignee: International Telephone and Telegraph Corporation, New York, N.Y.

[21] Appl. No.: 698,419

[22] Filed: June 21, 1976

[51] Int. Cl.[2] ..... G10K 1/06

[52] U.S. Cl. ..... 340/397; 340/392; 340/402

[58] Field of Search ..... 340/392, 397, 402

[56] References Cited

U.S. PATENT DOCUMENTS

| | | | |
|---|---|---|---|
| 2,468,474 | 4/1949 | Whidden | 340/392 |
| 2,590,500 | 3/1952 | Bredehoft | 340/397 |

*Primary Examiner*—Harold I. Pitts

*Attorney, Agent, or Firm*—J. B. Raden; M. M. Chaban

[57] ABSTRACT

A telephone-type ringer assembly with an improved volume control operable from the exterior of the closed housing in which the ringer is contained. The volume control comprises an eccentric control wheel for one gong to settably vary the distance from the striker to one gong. The setting of the gong is controlled by a detent pivoting the control wheel with the detent position being controlled by a rod having an eccentric connection to a setting control on the housing exterior or directly through a suitable slot in the base which does not require the rod and attached lever.

The ringer is designed to be mounted to the base directly on bosses molded onto the ringer frame. This mounting alternatively allows a detent spring extension to project through the bottom of the base for direct control, eliminating the need for a linkage. Pivotal movement of the control advances or retracts the rod to pivot the detent accordingly, the detent mating with plural position stops in the assembly within the ambit of lateral extent travel stops.

9 Claims, 5 Drawing Figures

RINGER ASSEMBLY

BACKGROUND OF THE INVENTION

Ringer assemblies with volume controls of various types are generally known in the telephone arts. In more recent Bell System phones, the control is effected by an eccentric rotary adjustment of one gong which is truck by the clapper. For example, see U.S. Pat. No. 2,590,500 to Bredehoft et al issued 3/25/52 for a showing of the ringer assembly in use in the Bell 500 series telephones.

In that patent, the gongs are mounted on mounting axes essentially parallel to position of the clapper arm in its normal position. A rotatable control wheel is mounted on the stationary assembly frame. The wheel mounting allows rotation of the wheel relative to the assembly. The wheel has a sector of its periphery extending through a slot in the undersurface of the telephone base to enable manual rotation of the wheel through an arc of predetermined extent.

One gong is mounted on the sheel with its mounting eccentric to the wheel mounting. On rotation of the wheel, the gong periphery opposite the clapper describes a path varying the distance from clapper to gong. By rotating the wheel, the distance of the gong periphery from the clapper is varied to vary the volume of the ringing emanating from the gong.

To hold the wheel and gong in a position once set and yet enabling the position to be overcome by the manual motion of the thumbwheel a flat spring is mounted to rotate with the wheel. The flat spring has a boss which mates with suitable indentations in the assembly frame to hold the wheel once set. The mating of the boss in an indentation may be overcome by manual rotative force applied to the wheel.

Further, the flat spring has a second arm which offset outwardly of the wheel periphery to engage travel limit stops extending radially on the frame edge. A finger raised from the plane of the wheel engages one side of the wheel travel limit arm to hold the arm in place and make the rotation and limit stop a more rigid structure.

SUMMARY OF THE INVENTION

The ringer assembly of the present invention uses many of the principles of the Bredehoft et al patent previously described. The gongs are however, positioned with their mounting axis perpendicular to the plane of the clapper arm.

The principle of the control wheel rotatable on one axis and mounting thereon the gong on an axis eccentric to the wheel axis is also used. The flat spring position stop and travel limit stop is also employed. A plurality of added uses are made of the flat spring. An offset is provided on a spring arm to mate with a wheel rotating rod, the rod being secured in a linkage accessible from the exterior of the phone base. In this way a fully enclosed base may be provided without slots and other openings allowing the incursion of bugs and the like into the phone base housing the ringer.

It is a further object of the invention to provide an improved telephone ringer assembly totally enclosed within a telephone base and having a volume control, gong-rotating wheel manipulatable through the use of the position stop spring of the ringer.

It is a still further object of the invention to provide an improved volume control assembly for a telephone ringer using the gong position spring for rotating the gong eccentrically relative to the clapper.

It is an object of the invention to provide a ringer usuable in a plurality of mounting modes and of volume control operating modes.

It is also an object of this invention to provide a ringer frame upon which a plurality of ringer motor mechanisms can be mounted.

The ringer frame provides all the functions except those directly related to the clapper ball and its activation. Thus, numerous motor mechanisms can be mounted as necessary to meet various ringer requirements over the world.

Figure 1:
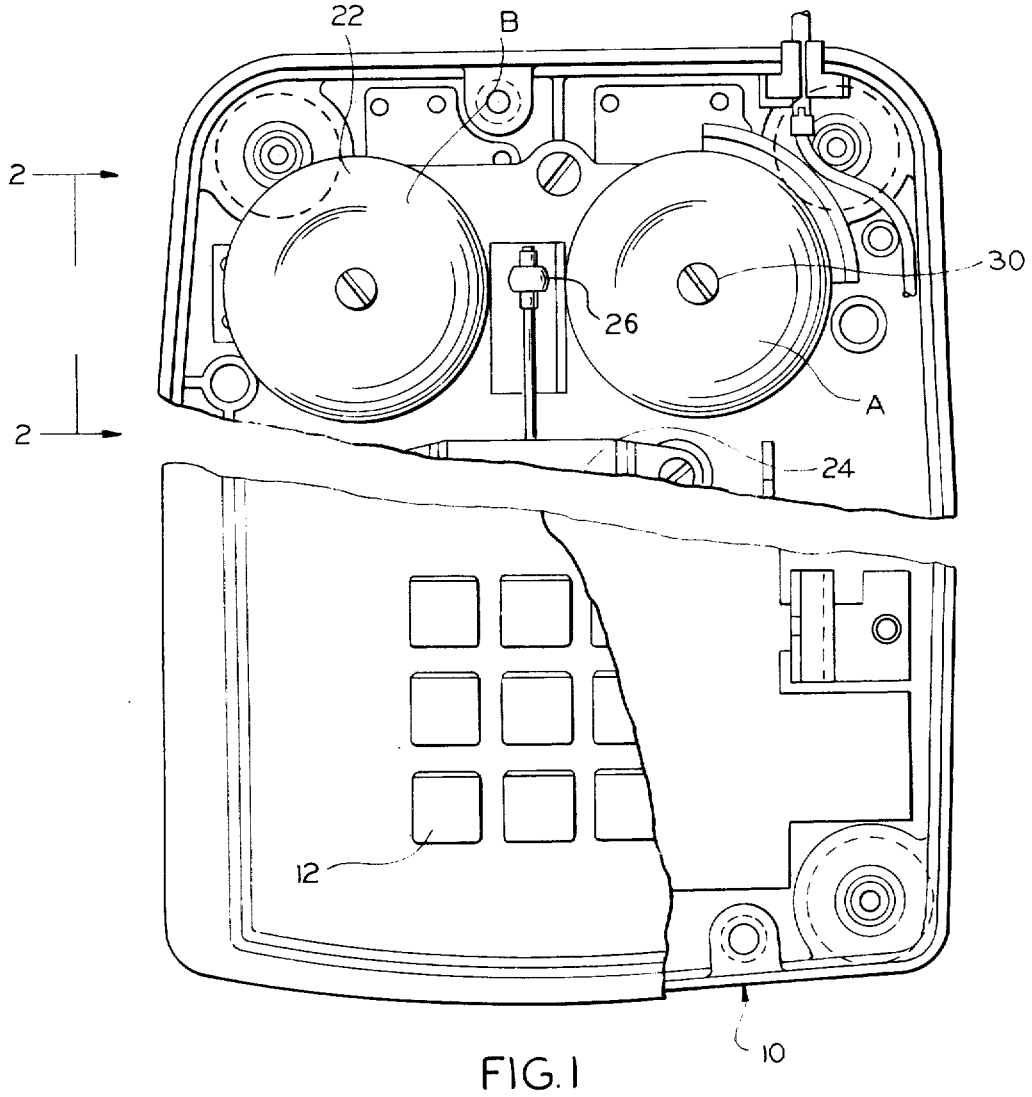
FIG. 1 is a plan view partially broken away of a telephone instrument base.
Figure 2:
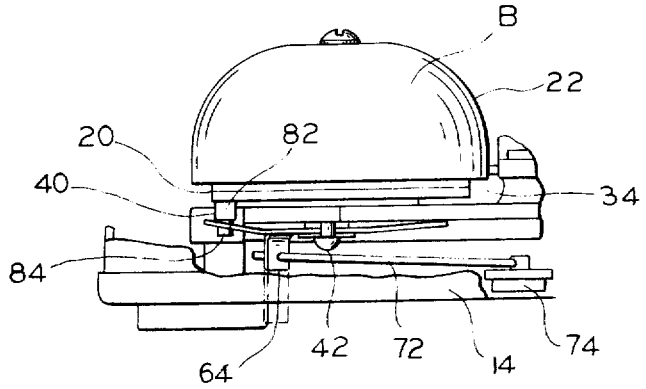
FIG. 2 is a section taken along line 2—2 of FIG. 1.

DETAILED DESCRIPTION OF THE DRAWINGS:

In FIG. 1, I show a telephone instrument base 10 of the general configuration of the well-known Bell 500 telephone subset equipped with a pushbutton dial 12. The phone base has a flat bottom base plate 14 onto which are mounted the internal operating components of the base. The base plate 14 shown in FIGS. 1 and 2 is of an imperforate type with no openings or slots. The imperforate base is provided to prevent the incursion of insects and the like where the phone is to be used in tropical or semi-tropical surroundings. Thus any adjustments to the instrument circuit which are to be permitted to the instrument user must employ linkages operable fully from the instrument exterior.

The volume control for the ringer is one example of a control which must be implemented in a manner maintaining the closed character of the instrument base. Mounted on the underside of the base plate in a manner allowing pivotal movement in a plane parallel to the base plate is a manually operable angularly movable lever arm 20. The arm is pinned to the base plate allowing rotational movement of the lever arm to a limited angular extent.

The lever, as mentioned, is rotatable in a plane parallel to the base plate and thus will be contained closely adjacent the base plate preferably within protective side enclosure walls, as will be explained later in greater detail.

Turning to the ringer itself, as seen best in FIGS. 1 and 2, a ringer mounting frame 20 has the ringer assembly affixed to it. The frame is mounted on the upper surface of the base plate adjacent the back end of the base, the back end being defined as that opposite the dial or pushbutton key pad end, i.e., the front end. The ringer assembly frame 21 is secured by screws, etc. through suitable mounting feet to position the gongs 22, drive motor 24 and clapper 26 above the frame. The ringer drive motor may be any suitable type and is secured with its axis essentially parallel to the top surface of the frame and with its armature perpendicular to the surface. The ringer clapper 26 which may be part of the ringing motor and therefor secured to the armature in any suitable manner, extends parallel to the frame upper surface to extend substantially midway between the gongs.

One gong A is stationarily secured by a screw 30 to the frame by means of an upwardly extending boss which may be integrally fabricated or cast as part of the frame.

The second gong B to which the volume control applies is secured by suitable screws or the like on an upwardly extending internally threaded boss (not shown), the boss however being an integral part of a rotatable wheel 34 called the control wheel. The control wheel is mounted on the frame 21 with its axis of rotation eccentric to the central axis of the gong B. The control wheel is rotatable relative to the frame by a pivot screw 36 extending through a tubular opening in the frame.

With the position of the clapper fixed relative to the frame, and the eccentric mounting of the gong B wheel relative to the frame, rotation of the wheel will vary the distance of the wall of gong B adjacent to the clapper. By this adjustment, the volume of the gong output can be varied, this general principle being known from the previously cited patent.

The wheel has a depending finger or boss 40 extending perpendicularly from its periphery for purposes which will be explained later. The wheel has a cylindrical opening for its pivot mounting to the frame (not shown). The mounting frame in the area of the wheel has an arcuate peripheral inset 44 concentric to the wheel rotational axis and extending over slightly more than 90° of arc about the wheel axis. The angular limits of the inset are formed by limit walls.

Figure 3:
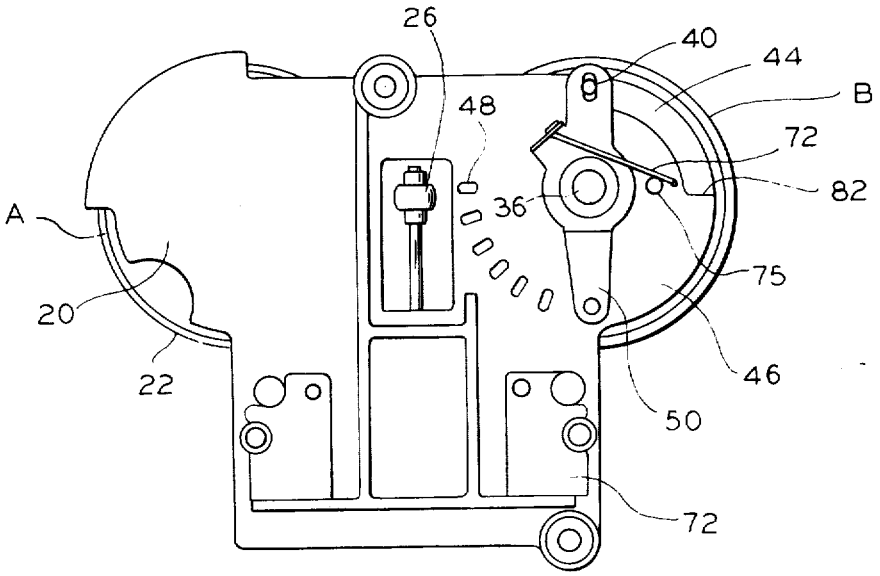
FIG. 3 is a bottom side view in elevation of the ringer assembly structure of FIG. 1.
Figure 5:
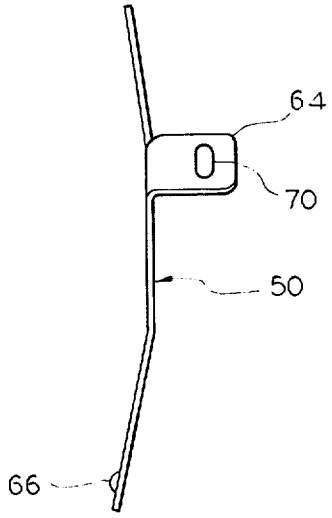
FIG. 5 is a side view of the spring of FIG. 4.
Figure 4:
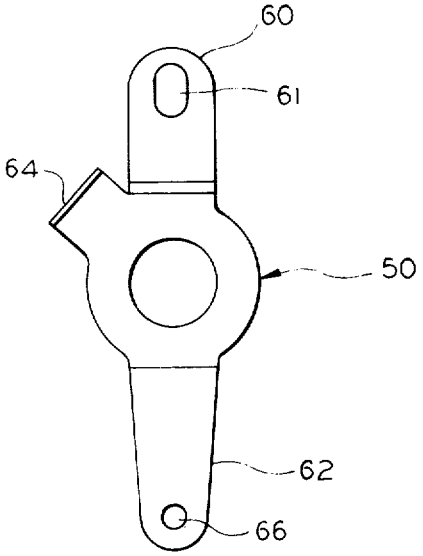
FIG. 4 is a plan view in elevation of the flat spring of FIG. 1.

Diametrally opposite the inset 44 (FIG. 3) on the underside 46 of the frame 21 are a plurality of depressions 48 spaced in an arcuate pattern concentric to the rotational axis of wheel 34. The ringer frame may be otherwise conventional and similar to that shown in the previously cited patent.

Mounted for rotation with the wheel is a generally flat positioning or detent spring 50. The spring is secured to the wheel by screw 36 extending through the tubular opening in the frame and suitably affixed to the control wheel. The spring is slightly bowed toward the wheel from its central hub 56 to provide a measure of tension on the spring directed toward the wheel.

The detent spring 50 is a flat spring which may be phosphor-bronze, iron phosphor or the like to provide inherent spring characteristics which has two diametrally disposed lobes 60 and 62 in a common plane and a third lobe 64 angularly directed from the spring hub. Of the two planar lobes, one lobe 60 has an opening 61 for receiving and mating with the downwardly directed wheel boss 40 to place the detent spring and wheel in registry for common rotation. In this way, the need for square hole mountings and other means of placing the wheel and spring in common registry are eliminated.

The opposed lobe 62 has an emboss 66 with its convexity directed toward the wheel for mating with the arcuate alignment of depression in the stationary ringer frame. By this configuration, rotation of the spring causes rotation of the wheel between the positions determined by the mating of the spring emboss in the depressions within the limits defined by the inset walls of frame and the travel of the wheel finger therein.

The third lobe 64 extends normally from the spring hub and has an opening 70 adjacent its free end for receiving therein a control rod 72. The rod may have its free end bent over. The rod 72 extends from its engagement with the spring lobe 64 to a similar connection to a pivotal member 74 secured to the instrument base plate. The pivotal member is connected or integral to the pivotal volume control lever 20 previously described. Adjacent member 74 (in FIG. 3) is a stop emboss 75. This stop prevents the ringer from being fully turned off. On installation, the stop may be physically removed by the installer when it is desired that the ringer may be shut off completely.

Thus when the pivot lever 20 is moved, the rod is moved accordingly to rotate the spring and wheel accordingly between the travel limits previously described.

As seen best in FIG. 2, boss 40 has a larger diameter section 80 which rides within the annular peripheral inset 44 to engage end walls such as wall 82 (FIG. 3) of the inset to provide the travel limit in one direction for the wheel rotation. A similar wall (not shown) at the other end of the inset provides the other travel limit for engagement by the boss 40.

At the end of section 80, a shoulder leads to the small diameter section 84 of boss 40 which is received in the oval opening 61 of the detent spring to join the detent spring to the wheel for joint rotation.

The manual control lever controls movement of the rod 72 and consequent movement of spring 50 and control wheel 34 through the previously described engagement with boss 40. The embossed lobe 62 of the detent spring provides the finite position control of the wheel relative to the frame. The eccentric mounting of the gong B in the control wheel 40 causes the distance of the gong wall from the clapper to vary on rotation of the wheel providing the desired volume control. By this construction, gongs may be mounted on the telephone instrument base with their mounting axes normal to the base plate of the instrument. The volume control may be manipulated from outside the base with all openings in the instrument base plate suitably covered.

Alternatively, the third lobe 64 may be elongated in a vertical sense to extend through an arcuate slot in the base surface, enabling manual manipulation from the exterior of the subset lobe to provide the volume control.

I claim:

1. A telephone ringer assembly adapted to mount on a mounting base within a totally enclosed housing, said assembly comprising a clapper and a gong, said gong having a circular section concentric about a first axis normal to said mounting base in which said clapper is normally spaced from said gong a settable distance through which said clapper can travel on actuation thereof to strike the gong and emit a ring, means for variably setting said gong to vary the distance of said gong from said clapper, said setting means comprising a wheel rotatable on a second axis normal to a frame member with said gong mounted on said wheel for rotation therewith, means mounting said gong on said first axis eccentric to said second axis for rotation relative to said second axis, spring means mounted on said second axis and including a first member cooperative with said frame member to position said wheel in one of a finite plurality of positions, a second member of said spring means engaging said wheel for rotating said wheel responsive to rotation of said spring means, and a further member of said spring means including a driving member for causing rotation of said spring means and wheel.

2. A telephone ringer assembly as claimed in claim 1, wherein said spring means comprises a leaf spring, and said spring means members comprise lobes of said spring means radial to the first axis.

3. A telephone ringer assembly as claimed in claim 2, wherein said spring means second member comprises an openibg in the spring means lobe, and in which there is an emboss finger extending from said wheel parallel to the second axis for resting in said spring means lobe opening.

4. A telephone ringer assembly as claimed in claim 3, in which there is an inset in said frame member with the emboss finger extending in said inset and radial terminal walls of said inset forming rotative limit stops for the travel of said emboss finger.

5. A telephone ringer assembly as claimed in claim 4 wherein said spring means further member comprises a lobe having its free end extending parallel to said second axis for receiving said driving member, said driving member being a control rod parallel to the mounting base within said housing.

6. A telephone ringer as claimed in claim 4, wherein said spring means further member comprises a lobe adapted for response to manual manipulation.

7. A telephone subset having an enclosed housing with a ringer assembly stationarily mounted therein, said assembly comprising a clapper and a pair of gongs in which said clapper is normally spaced between said gongs a settable distance through which said clapper can travel on actuation thereof to strike the gongs and emit a ring, means for controlling the volume of output from said ringer by variably setting one of said gongs into one of a plurality of finite positions whereby to vary the distance of said one gong from said clapper, said setting means comprising a wheel rotatable on a first axis normal to the mounting base of said subset, with said one gong mounted on said wheel for rotation therewith and said one gong mounted on a second axis eccentric to said first axis, a control member mounted on said first axis and including a first radial arm cooperative with a stationary frame member of said assembly to position said wheel in one of said plurality of positions, a second radial arm of said control member engaging said wheel for rotating said wheel responsive to rotation of said control member, and a further arm of said control member including a driving connection extending within said housing for causing rotation of said gong eccentrically about said first axis.

8. A telephone subset as claimed in claim 7, wherein said driving connection includes a control manipulable externally to said handset and an axially extensible rod engaging said further arm of said control member to rotate said member and said wheel responsive to said external manipulation.

9. A telephone subset as claimed in claim 8, wherein said control member comprises a leaf spring with its first and second arms tensioned toward the wheel.

* * * * *